United States Patent [19]

Roccaforte et al.

[11] Patent Number: 4,524,870

[45] Date of Patent: Jun. 25, 1985

[54] VISIBLE AND EASY ACCESSIBLE PACKAGE

[75] Inventors: Harry I. Roccaforte, Western Springs; Robert A. Christie, Mundelein, both of Ill.

[73] Assignee: Champion International Corporation, Stamford, Conn.

[21] Appl. No.: 529,521

[22] Filed: Sep. 6, 1983

[51] Int. Cl.[3] ..... B65D 65/28

[52] U.S. Cl. ..... 206/608; 206/45.33; 206/615; 206/620

[58] Field of Search ..... 206/620, 634, 45.33, 206/45.34, 622, 630, 629, 633, 615, 608, 605, 628, 627, 611; 229/30, 32, 34 A

[56] References Cited

U.S. PATENT DOCUMENTS

| | | | |
|---|---|---|---|
| 279,756 | 6/1883 | Heston | 229/32 |
| 3,069,273 | 12/1962 | Wayne | 206/628 X |
| 3,273,302 | 9/1966 | Walter | 206/611 X |
| 3,398,876 | 8/1968 | Ward | 206/628 X |
| 3,495,759 | 2/1970 | Bergstrom et al. | 206/633 X |
| 3,825,169 | 7/1974 | Meyers | 229/34 A |
| 3,863,832 | 2/1975 | Gordon et al. | 229/30 |

FOREIGN PATENT DOCUMENTS

| | | | |
|---|---|---|---|
| 104825 | 12/1962 | Netherlands | 206/45.34 |

*Primary Examiner*—Allan N. Shoap
*Assistant Examiner*—Bryon Gehman
*Attorney, Agent, or Firm*—Evelyn M. Sommer

[57] ABSTRACT

A blank for forming a tray having a bottom wall panel and a pair of side wall panels extending therefrom and foldable relative thereto, with each side wall panel having a side flap extending therefrom. A pair of end panels extend from the bottom wall panel and are foldable relative thereto with the end panels each having an end flap extending therefrom. The end flap is connected to the end wall panel by a tearable fold line to permit the end flap to be removed therefrom. A transparent cover assembly made of plastic extends over the tray and is adhered to the side flanges and the end flaps. The side flaps and the end flaps are then folded down against the side walls and the end walls of the tray and adhered thereto. An end flap is then lifted and when pulled up, the transparent cover assembly will sever easily to permit access to the contents of the package.

1 Claim, 6 Drawing Figures

VISIBLE AND EASY ACCESSIBLE PACKAGE

BACKGROUND OF THE INVENTION

The present invention is directed to a package and more particularly to an improved package which has a transparent cover to permit viewing of the contents and which is removable to gain access to the contents of the package.

Medical devices, confections, and other such similar articles require easy, quick and efficient access, especially in emergency situations. Hence, it is quite important that a package containing the right device be quickly chosen and that the packaged contents be quickly and easily removed.

Packages for such devices have been designed with several types of easy opening devices. In some instances, the covers of such cartons have been provided with an illustration of the product as one method of indicating what is packaged therein. This is an expensive procedure since it entails printing of the package as well as the use of sturdy cover materials. Packages with transparent covers have also been used. However, such packages do not have easily accessible means for opening them so that the transparent cover must usually be torn open which is a time-consuming operation.

BRIEF DESCRIPTION OF THE INVENTION

The present invention overcomes these difficulties and has for one of its objects an improved package which has a cover assembly which may be easily removed without special tools and with little or no effort.

Another object of the present invention is the provision of an improved package having a cover assembly which can be removed quickly.

Another object of the present invention is the provision of an improved package in which the contents are clearly visible through a transparent cover assembly.

Another object of the present invention is the provision of an improved package in which the package may be easily assembled by automatic machinery.

Other and further objects of the invention will be obvious upon an understanding of the illustrative embodiment about to be described, or will be indicated in the appended claims, and various advantages not referred to herein will occur to one skilled in the art upon employment of the invention in practice.

The improved package consists of a tray with side flaps and end flaps extending thereon. A transparent cover seal extends over the tray and is adhered to the side and end flaps. The side and end flaps are then folded down against the side and end walls of the tray and adhered thereto. An end flap is then lifted and when pulled up, the transparent cover assembly will sever easily to permit access to the contents of the package.

A preferred embodiment of the invention has been chosen for purposes of illustration and description and is shown in the accompanying drawings forming a part of the specification, wherein:

DESCRIPTION OF THE INVENTION

Figure 1:
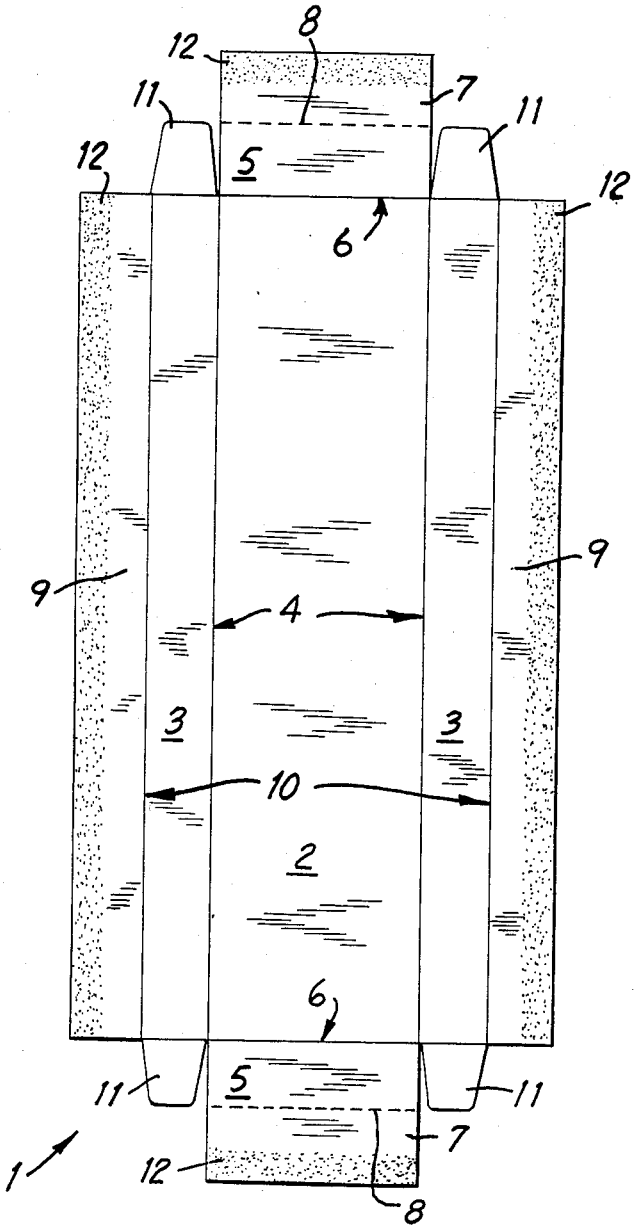
FIG. 1 is a plan view of a blank which is used to make the tray of the present invention.
Figure 2:
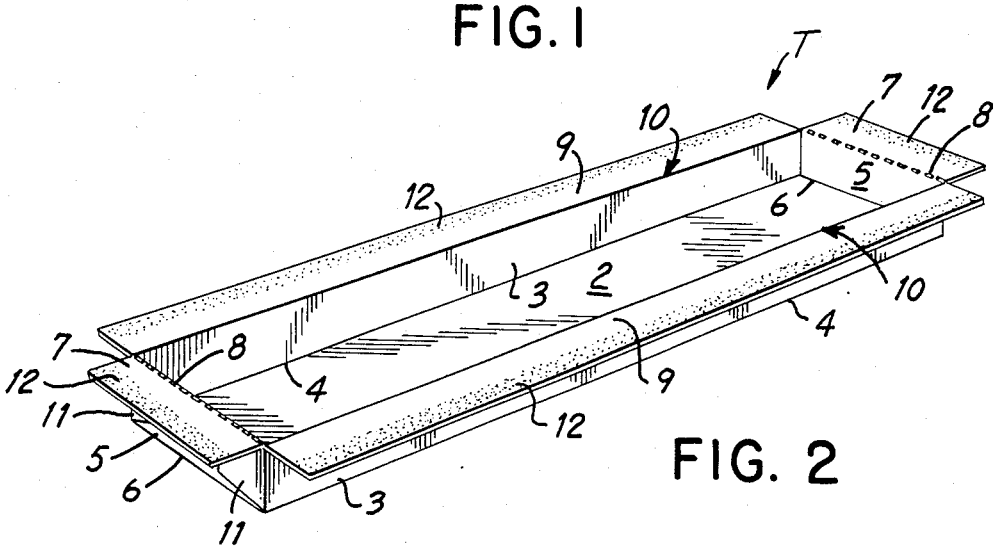
FIG. 2 is a perspective view of the tray showing it in partially assembled condition before the transparent cover assembly is applied thereto.

Referring more particularly to the drawings and particularly to FIG. 1, a one-piece blank 1 is used to form the tray T (FIG. 2) of the package P (FIG. 4) of the present invention. The blank 1 comprises a bottom panel 2 and a pair of side wall panels 3 foldably connected thereto along side fold lines 4. End wall panels 5 extend from the bottom wall panel 2 and are foldably connected thereto along end fold lines 6. Each end wall panel 5 has an end flap 7 hingedly connected thereto by a fold line 8 which is preferably a perforated tear line. A side flap 9 extends from each side wall panel 3 and is foldable relative thereto along a fold line 10. The side wall panels 3 have foldable end tabs 11 extending from each end thereof which are adapted to be folded inwardly and adhered to the end walls 5 of the blank to complete the tray T.

The outer edge of each end flap 7 and each side flap 9 is preferably provided with a strip of adhesive 12 or coating, as shown in FIG. 1.

The tray 1 is erected by folding the end wall panels 5 and side wall panels 3 upwardly relative to the bottom wall panel 2 along their respective fold lines 6 and 4. The side flaps 9 and the end flaps 7 are bent backwardly along fold lines 10 and 8, respectively, until they assume a horizontal position at right angles to the side walls and end walls 3 and 5, respectively. The end tabs 11 are then folded inwardly and adhered to the outer surfaces of the end wall 5, as shown in FIG. 3.

Thereafter, a cover assembly 20 of preferably transparent material, such as a plastic, is placed over the entire tray and is adhered to the adhesive areas 12 on the horizontally disposed side flanges 9 and end flaps 7 by conventional means including radio frequency, ultra sound or any other suitable means. Preferably, the transparent cover assembly 20 has perforations 21 which overlie the fold lines 4 and 6. While the transparent cover assembly 20 is shown as being preferably adhered to the tray 1 by adhesive areas 12, it will be understood that it is within the purview of this invention to have the adhesive on the transparent cover assembly 20 or to apply adhesive to the side flanges 9 and end flaps 7 immediately before the cover assembly 20 is applied to the tray, or to have the cover assembly 20 or the tray T made of a material that the two are adhered to each other by heat or some other sealing means.

Figure 3:
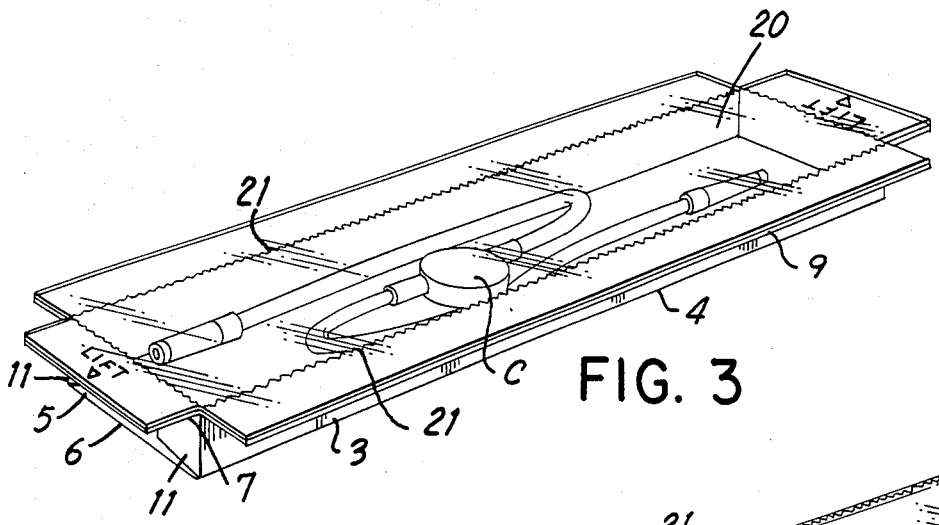
FIG. 3 is a perpective view of the tray showing the transparent cover assembly adhered thereto.

Preferably, the shape of the cover assembly 20 is substantially similar to the shape of the container with the flanges and flaps in their horizontal positions, as shown in FIG. 3. However, it will be understood that the shape may vary without departing from the scope of the present invention.

Figure 4:
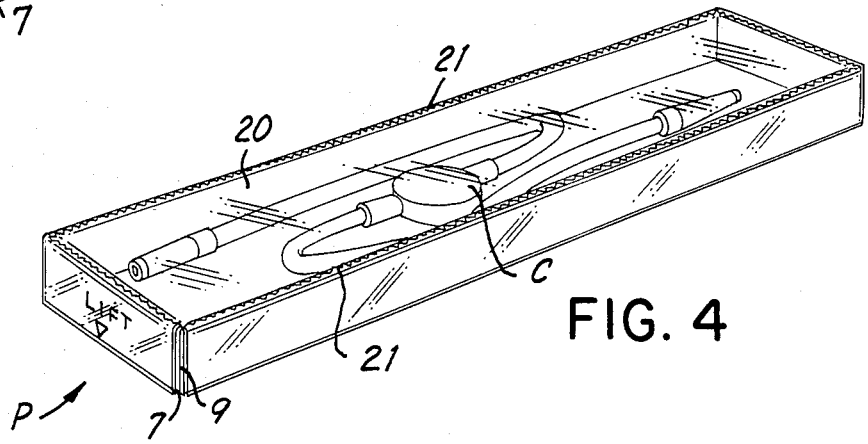
FIG. 4 is a perpective view showing the finished package.

After the cover assembly 20 is adhered to the end flaps 7 and side flaps 9, they are folded down as shown in FIG. 4 and are, in turn, adhered to the outer surfaces of side and end walls 3 and 5, respectively. The end flaps 7 are lightly adhered to the ends walls 5 to permit quick and easy lifting and removal as will be hereinafter more fully referred to.

In this position, the package may be stored or shipped and will remain in this position unitl it is ready to be used. Since the contents of the package are sterile and since the package is completely sealed, the contents of the package will remain sterile.

Figure 5:
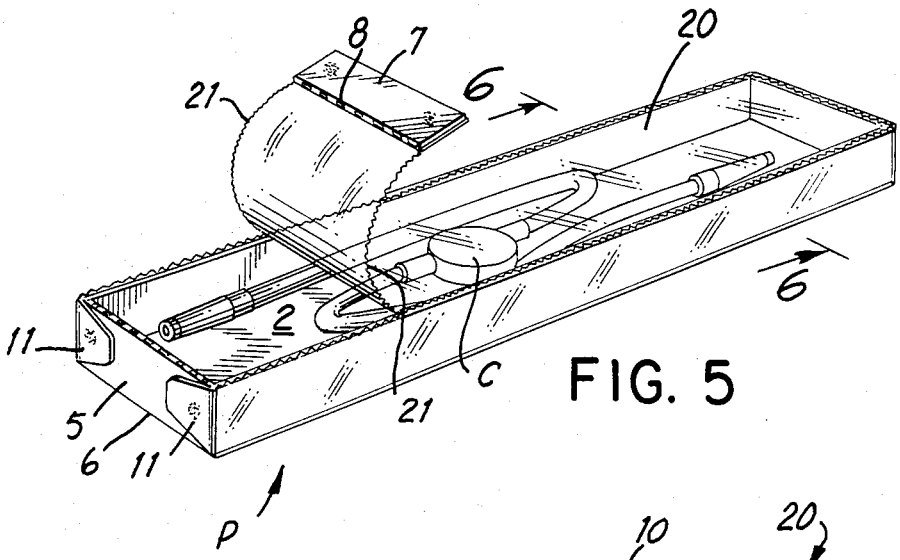
FIG. 5 is a similar perspective view showing the package in the process of being opened.
Figure 6:
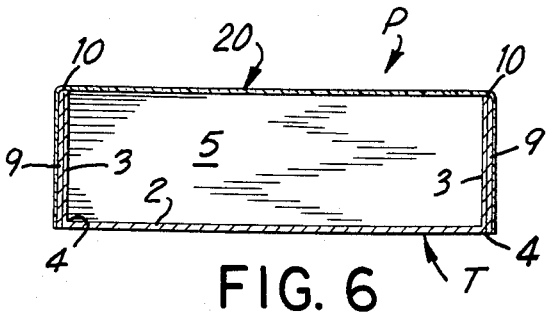
FIG. 6 is a sectional view taken along line 6—6 of FIG. 5.

When the contents of the package are to be used, an end flap 7 is grasped and lifted away from its side wall 5 breaking the adhesive bond between the two. Further lifting tears the transparent cover assembly 20 along the perforated lines 21, as shown in FIG. 5 to expose the contents C of the package P. If desired, the perforated lines 21 need not extend across the entire package but may extend across it for only a short distance. Likewise, it is within the purview of the present invention for the cover assembly 20 not to have perforated lines 21 in which event the force of the lifting of the end flaps 7 is sufficient to rip the cover assembly 20 and expose the contents C.

Preferably, the cover assembly 20 is shown as being transparent in order to permit the contents of the package to be viewed from the outside. However, it will be understood that it is within the purview of the present invention to make the cover assembly 20 opaque.

In addition, preferably the end flaps 7 at either end of the package may be lifted in order to sever the cover assembly 20 and, preferably, the indicia "lift-off" with an arrow may be provided in order to give accurate instructions to the user.

In addition, while for ease in description, the end flaps 7 have been shown and described as being lifted to expose the content C, it is within the purview of the invention for the side flaps 9 to be used in a similar manner to open the package.

It will thus be seen that the present invention provides an improved package which has a cover assembly which may be easily removed without difficulty or the use of special tools, which may be easily assembled by automatic machinery, and in which the contents are clearly and easily visible through a transparent cover.

As many and varied modifications of the subject matter of this invention will become apparent to those skilled in the art from the detailed description hereinabove, it will be understood that the present invention is limited only as provided in the claims appended hereto.

The embodiments of the invention in which an exclusive property or privilege is claimed are defined as follows:

1. A generally rectangular tray formed from a single blank of paperboard material, said tray being adapted to securely enclose an article stored therein yet enable easy and efficient access thereto, said tray comprising:

a rectangular bottom wall having pairs of opposed sides and ends;

a pair of rectangular upstanding side walls foldably connected respectively to the opposite sides of said bottom wall each said side wall comprising a rectangular side wall panel articulated to said bottom wall and a side flap articulated to the respective side wall panel along a fold line extending generally parallel to the bottom wall, said side flaps being foldably disposed in face-to-face contact with an outer surface of the respective side walls and adhesively secured thereto;

a pair of rectangular upstanding end walls foldably connected to the opposed ends of said bottom wall, each said end wall comprising a rectangular end wall panel articulated to said bottom wall and connected to the side walls, each said end wall further comprising an end flap articulated to said end wall panel along a cut fold line extending parallel to the bottom wall, each of said end flaps being folded into face-to-face contact with an outer surface of the respective end wall panel and adhesively secured thereto with a light bond adhesive which permits the respective end flap to be peeled away from the corresponding end wall panel; and a transparent plastic cover sheet extending between the articulations of said side and end flaps to the respective side and end wall panels, said cover sheet further including edge portions overlying outer surfaces of each of said side and end flaps and adhesively secured thereto, said cover sheet including a pair of rupturable cut score lines substantailly overlying and extending substantially entirely along the articulations between the respective side wall panels and side flaps to define a medial portion of said cover sheet intermediate said rupturable cut score lines, said medial portion of said cover sheet being separable from the adjacent edge portions thereof, whereby removal of either of said end flaps from its respective end wall panel enables separation of said medial portion from the remainder of said cover sheet to provide access to material stored in said tray.

* * * * *